United States Patent [19]

Kitchen et al.

[11] 4,135,835

[45] Jan. 23, 1979

[54] LATCH UNIT FOR ADJUSTABLE BED FRAME RAILS

[75] Inventors: John P. Kitchen; Terry L. Gabhart, both of Georgetown; Joseph S. Lanham, Lexington, all of Ky.

[73] Assignee: Hoover Universal, Inc., Saline, Mich.

[21] Appl. No.: 821,575

[22] Filed: Aug. 3, 1977

Related U.S. Application Data

[62] Division of Ser. No. 681,133, Apr. 28, 1976, Pat. No. 4,070,717.

[51] Int. Cl.[2] ..... F16B 7/14; A47C 19/04

[52] U.S. Cl. ..... 403/108; 5/200 C; 5/202; 135/15 PQ; 285/303

[58] Field of Search ..... 5/200 R, 201, 200 C, 5/202; 403/108, 325, 326, 328, 107; 248/407, 408, 260, 272, 295 B; 135/15 PQ; 285/303

[56] References Cited

U.S. PATENT DOCUMENTS

| | | | |
|---|---|---|---|
| 2,826,765 | 3/1958 | Entwistle | 5/200 R |
| 3,446,523 | 5/1969 | Little | 403/108 |
| 3,646,623 | 3/1972 | Harris et al. | 248/408 X |
| 3,656,494 | 4/1972 | Cornett et al. | 135/15 PQ |
| 3,781,930 | 1/1974 | Spitz | 5/201 |
| 3,871,039 | 3/1975 | Garceau | 5/200 R X |

FOREIGN PATENT DOCUMENTS

| | | | |
|---|---|---|---|
| 1139337 | 11/1962 | Fed. Rep. of Germany | 403/108 |
| 629729 | 9/1949 | United Kingdom | 403/108 |

*Primary Examiner*—Ernest R. Purser
*Assistant Examiner*—Conrad L. Berman
*Attorney, Agent, or Firm*—Olsen and Stephenson

[57] ABSTRACT

A latch unit for a pair of rectangular telescoped bed frame rails having overlapped side walls with aligned openings therein. The latch unit consists of a hollow rectangular body of one-piece, non-rigid construction, preferably yieldable plastic material, telescoped over the telescoped rails. One side of the body has a locking projection formed on it and shaped to fit in a pair of aligned openings in the rails so as to latch the rails against any relative movement. The side of the body which carries the locking projection is of a deformable shape enabling movement of the projection in a direction toward and away from the aligned openings in the rails.

3 Claims, 8 Drawing Figures

LATCH UNIT FOR ADJUSTABLE BED FRAME RAILS

CROSS REFERENCE TO RELATED APPLICATION

This application is a division of co-pending parent application Ser. No. 681,133, filed Apr. 28, 1976; now U.S. Pat. No. 4,070,717.

BACKGROUND OF THE INVENTION

A complete bed unit consists of a bed carrying frame, a box spring assembly mounted on the frame and a mattress supported on the box spring unit. A bed carrying frame consists essentially of a pair of side rails and a pair of end rails which are connected to the side rails so that they can be folded or disassembled for shipment and storage and assembled with the side rails at the bedsite so as to form a rectangular support for the box spring assembly. The usual bed frame that is available commercially is either difficult to assemble, difficult to fold up and ship, or is of a somewhat filmsy construction when assembled. Others are unduly costly to manufacture and others are difficult to adjust to fit various size box spring assemblies. It is an object of the present invention, therefore, to provide an improved bed carrying frame which is readily foldable for shipping and storage purposes, is easily assembled to a rigid rectangular form and is readily adjusted in size to support box spring assemblies of various sizes.

SUMMARY OF THE INVENTION

The bed carrying frame of this invention consists of a pair of parallel side rail members, each of which is of hollow rectangular shape, a pair of end rail units, each of which is comprised of two relatively telescoped end rail members which are also of hollow rectangular shape, and four corner bracket members, each of which mounts one of the end rail members on one of the side rail members. Each of the bracket members is secured to a side rail member and has a pair of vertically spaced flanges which are disposed on the top and bottom sides of an end rail member and are pivotally connected to the end rail member by an upright pin. A locating wall extends between the flanges in each bracket member and, in the assembled position of the bed frame, engages the side wall of an end rail member so as to locate the end rail member in a position perpendicular to its supporting side rail. Locking tabs on the flanges engage the opposite side of the end rail to maintain it in an assembled position. The tabs are also positioned to lock the end rails in their folded positions.

In the assembled position of the bed carrying frame of this invention, upright flanges on the corner brackets locate the box spring assembly on the frame. Latch units on the end rail units maintain the telescoped end rail members in adjusted positions so that the frame will maintain its rigid form. Each latch unit consists of a generally rectangular body of one piece non-rigid construction telescoped over the telescoped end rails. The end rails are provided with a series of alignable side wall openings so that for each adjusted length of an end rail unit, a pair of openings therein are aligned. The latch unit has a locking projection formed on one of its sides and shaped to fit in an aligned pair of openings in the end rails to thereby lock the end rails in predetermined relative positions. The latch unit body is of a deformable shape on the side which carries the locking projection to thereby enable manual manipulation of the body to move the locking projection in a direction axially of the aligned openings in the end rails. The projection can then readily be moved into and out of locking positions with respect to the end rails.

The result is a bed carrying frame which can readily be stored and shipped in a compact folded condition and later assembled to a desired size. When the frame is assembled for use, it maintains a rigid rectangular shape and will provide the necessary bed support over a prolonged service life.

Further objects, features and advantages of this invention will become apparent from a consideration of the following description, the appended claims, and the accompanying drawing in which:

Figure 1:
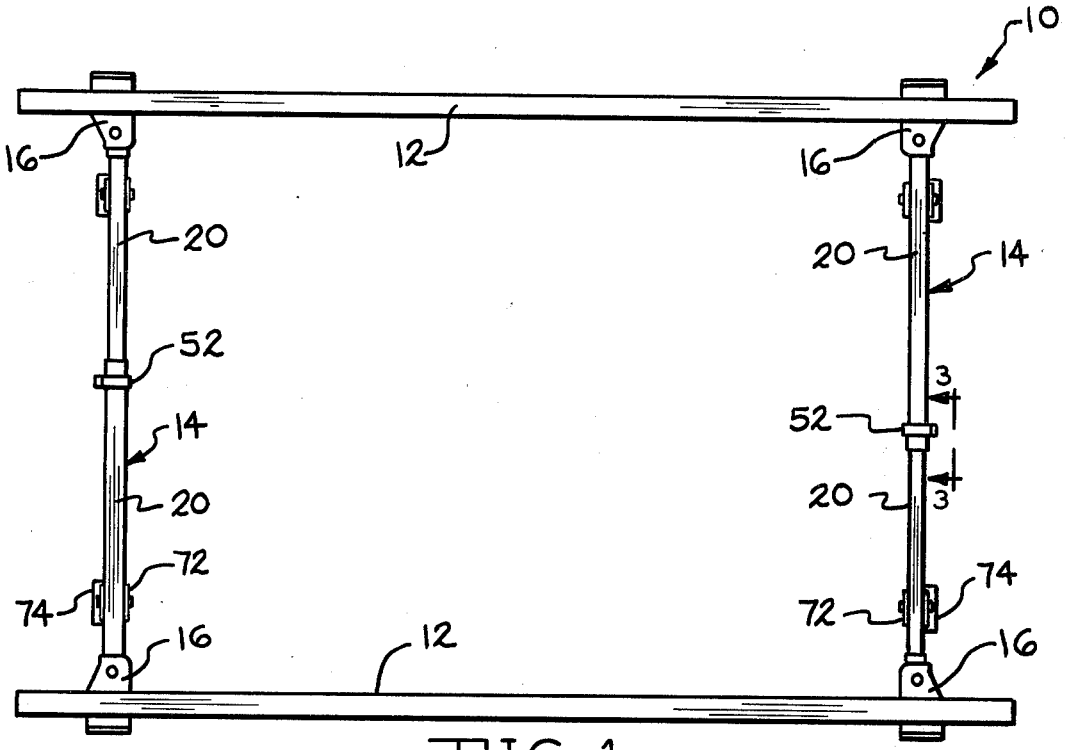
FIG. 1 is a plan view of the bed carrying frame of this invention showing the frame in assembled position.
Figure 3:
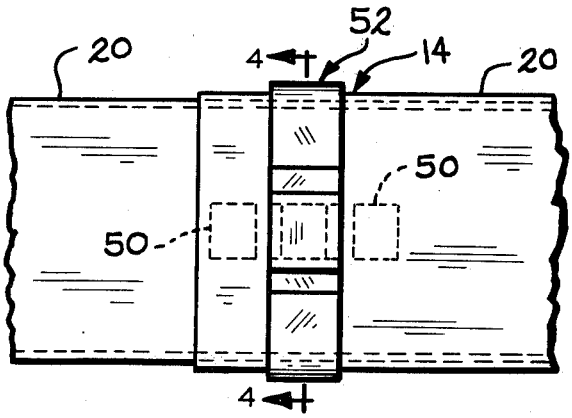
FIG. 3 is an enlarged fragmentary view of a portion of an end rail unit in the bed carrying frame of this invention, as seen from substantially the line 3—3 in FIG. 1.
Figure 4:
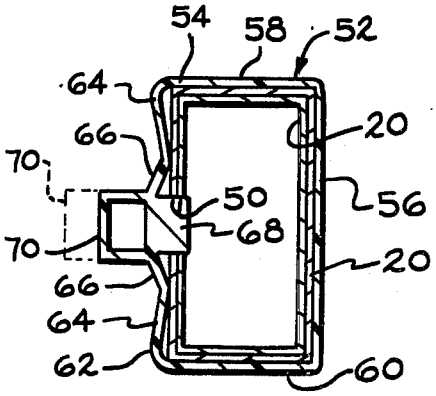
FIG. 4 is a transverse sectional view of an end rail unit and the latch unit mounted thereon as seen from substantially the line 4—4 in FIG. 3.
Figure 6:
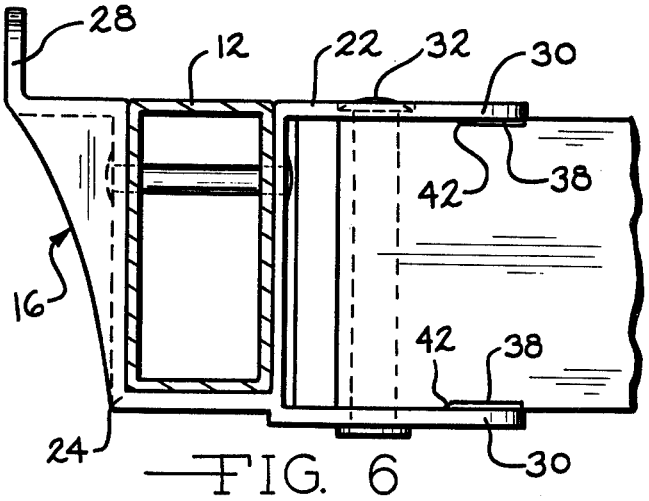
FIG. 6 is an end view of the structure shown in FIG. 5.

With reference to the drawing, the bed carrying frame of this invention, indicated generally at 10, is illustrated in FIG. 1 as including a pair of parallel side frame members 12, a pair of end rail units 14 and four corner bracket members 16 which function to connect the side rail members 12 and the end rail units 14. The side rail members 12 are identical, and as shown in FIG. 6, each of the members 12 is of a rectangular hollow shape. Similarly, the end rail units 14 are identical, each consisting of a pair of relatively telescoped end rail members 20, which are also of rectangular hollow shape, one of the end rail members 20 being slightly smaller than the other so that it can be telescoped inside the larger rail member 20, as shown in FIGS. 3 and 4.

Figure 8:
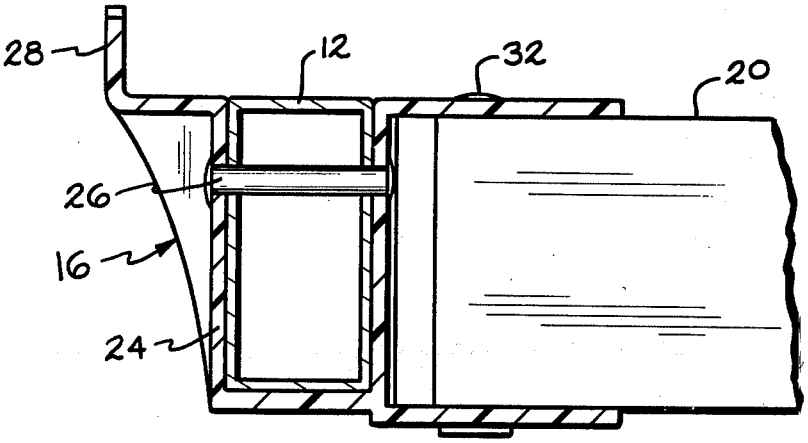
FIG. 8 is a sectional view of the structure shown in FIG. 5 as seen from substantially the line 8—8 in FIG. 5.

The corner bracket members 16 are also substantially identical; the pair of bracket members on each side rail 12 being right and left hand versions of the same structure. Accordingly, only one corner bracket member 16 and the assembly thereof with a side rail 12 and an end rail member 20 will be described in detail herein, with like numerals representing like parts at each corner of the frame 10. Referring to FIGS. 6 and 8, a corner bracket member 16 consists of one piece molded body 22 having a trough shape portion 24 shaped to accommodate a side rail member 12 and having a side rail member 12 disposed therein and secured thereto by rivets 26. On one side of the trough shape portion 24, the body 22 is provided with an upstanding flange 28 which functions to locate a box spring assembly on the assembled frame 10. As shown in FIG. 1, the flanges 28 on the brackets 16 on each side rail 12 are substantially coplanar and are parallel to the side rail 12.

Figure 7:
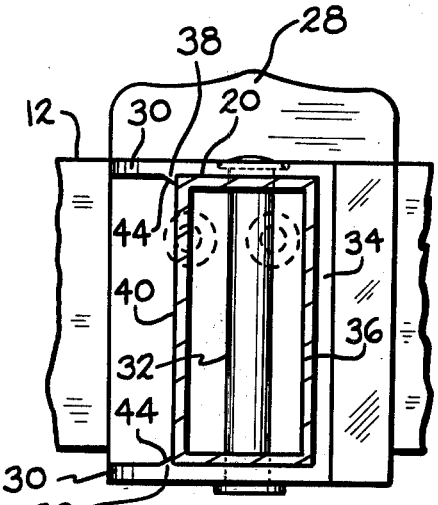
FIG. 7 is a side view of the structure shown in FIG. 6.

A pair of vertically spaced flange portions 30 are formed on the body 22 on the opposite side of the trough shape portion 24. The flange portions 30 are spaced apart a distance corresponding to the vertical dimension of an end rail member 20 which is located between and pivotally mounted on the flange portions 30 by a vertically extending pivot pin 32 which extends downwardly through the flange portions 30 and the end rail member 20 disposed therebetween. As shown in FIG. 7, the flange portions 30 are connected on one side by an upright wall 34 which is located to engage one side wall 36 of the end rail member 20 when the end rail member 20 is in a position shown in FIG. 1, perpendicular to the side rail member 12 on which it is mounted. In this position of the end rail member 20, sometimes referred to as the assembly position, a pair of tabs 38, which are formed on the flange portions 30 so that they extend toward each other, engage the opposite side 40 of the end rail member 20. As a consequence, the end rail member 20 is firmly clamped on the bracket 16 between the wall 34 and the tabs 38.

Figure 2:
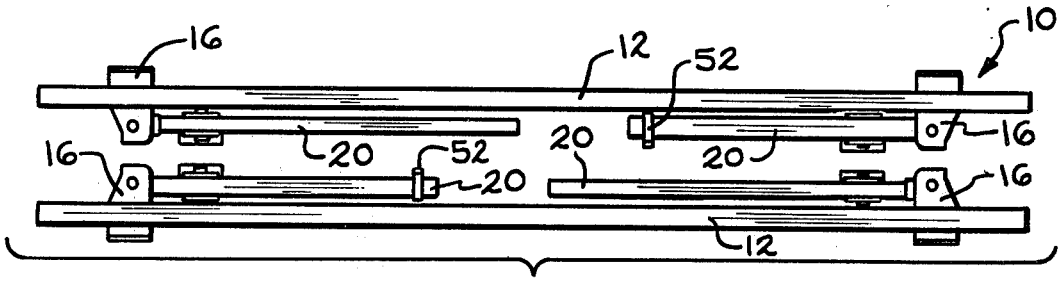
FIG. 2 is a plan view of the bed carrying frame of this invention showing the frame disassembled and folded for storage or shipping purposes.
Figure 5:
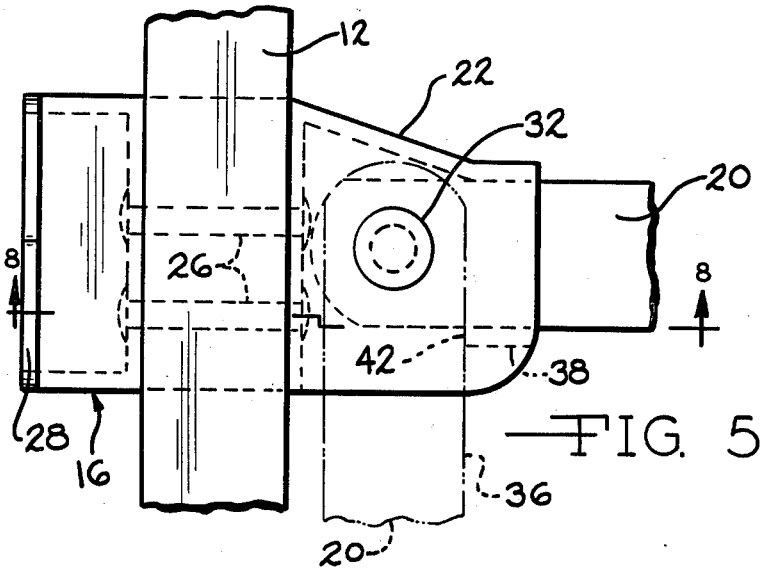
FIG. 5 is a plan view of a portion of the bed carrying frame of this invention consisting of a corner bracket member, a side rail member and an end rail member, showing the end rail member in folded position in broken lines.

During shipment of the bed carrying frame 18, the side rail members 20 are in their storage or shipping positions, shown in FIG. 2 in which they are folded against the side rails 12 so that they will take up a minimum of shipping and storage space. As shown in FIG. 5, when an end rail member 20 is in the folded position, shown in broken lines in FIG. 5, the side wall 36 of the rail 20 is engaged by the ends 42 of the tabs 38. Thus, the tabs 38 are positioned and dimensioned so that they function to hold the end rail member 20 in both its folded and assembled positions shown in solid and broken lines, respectively, in FIG. 5.

As shown in FIG. 6, the ends 42 of the tabs 38 are beveled or inclined to facilitate movement of the end rail member 20 from the folded position thereof to the assembly position. Also, the sides 44 of the tabs 38 are inclined to facilitate this movement. Once the frame 10 has been assembled, the tabs 38 function to firmly hold the end rails 20 in assembled position. However, should it later be desired to disassemble the frame 10 and return the end rails 20 to their folded positions shown in FIG. 2, the flange portions 30 can readily be manually sprung apart to allow the end rail member 20 to be moved between the tabs 38. The bracket member 16 is preferably formed of a yieldable plastic material that will readily accommodate this springing movement.

As shown in FIGS. 3 and 4, relatively telescoped end rail members 20 are formed with side wall openings 50 which are alignable in adjusted positions of the end rails 20 to accommodate the frame 10 to a box spring assembly of a particular size. A latch unit 52 consisting of a hollow generally rectangular shape body 54, preferably formed of nylon or equivalent plastic material, is telescoped over each pair of telescoped end rail members 20 and is operable to maintain the members 20 in predetermined adjusted positions. The body 54 has three sides, 56, 58 and 60 which are dimensioned to fit the body 54 snugly onto the larger one of the telescoped rails 20 permitting sliding movement of the body 54 longitudinally of the rail 20 but eliminating significant movement of the body 54 in other directions. The fourth side 62 of the body 54 is longer than the opposite side 56 because it has angularly related sections 64 and 66 which enable the wall 62 to be manually deformed.

A locking projection 68 of rectangular shape sized to telescope into the openings 50 is formed on the wall 62 and is movable into a pair of aligned openings 50 so as to lock the telescoped end rail members 20 in relatively adjusted positions. A handle 70 is formed on the wall 62 opposite the projection 68 for movement between the solid and broken line positions shown in FIG. 4 in which the projection 68 is moved axially of the aligned openings 50 between the locking position shown in solid lines and a release position removed from the openings 50. In the latter position, relative telescoping movement of the end rails 20 can be accomplished.

Thus, the latch units 52 constitute a simple and effective mechanism for maintaining the frame 10 in an adjusted position. The wall 62 in each unit 52 is stressed so that it tends to hold the projection 68 in the locking position shown in solid lines in FIG. 4 so that it is necessary to forcefully move the handle 70 so as to withdraw the projection from the openings 50. Each end rail 20 has a leg unit 72 (FIG. 1) mounted thereon and extending downwardly therefrom. Each unit 72 includes a roller caster 74 which engages the floor.

From the above description, it is seen that this invention provides an improved bed carrying frame 10 in which the side rails 12 and the end rail units 14 are relatively assembled so that the frame 10 can readily be shipped and stored in the form shown in FIG. 2 and placed in use in the form shown in FIG. 1. The constructions of the corner brackets 16 and the latch units 52 facilitate this assembly.

What is claimed:

1. A latch unit for a pair of rectangular telescoped rails having a pair of adjacent side walls with aligned openings therein, said unit comprising a hollow rectangular body of one-piece, non-rigid construction telescoped over said telescoped rails, a locking projection integrally formed with said body on one side thereof and shaped to fit in said pair of said aligned openings in said rails so as to latch said rails in predetermined relative positions, said one side of said body being of a deformable shape enabling movement of said projection in a direction axially of said aligned openings between a position extending into said openings and a position withdrawn from said openings, and handle means on said one side of said body positioned in substantial alignment with said locking projection so as to be manually operable to withdraw said locking projection from said aligned openings.

2. A latch unit according to claim 1 wherein said hollow rectangular body is dimensioned on the side opposite said one side and on the remaining two sides thereof to fit snugly on said rails, said one side being of a length in a direction circumferentially of said body greater than the length of said opposite side, said one side also being of irregular non-linear shape enabling the deformation thereof to accommodate movement of said projection into and out of said openings.

3. A latch unit according to claim 2 wherein said one side has angularly related sections thereby extending the effective length of said one side.

* * * * *